US006560876B2

(12) United States Patent
Carr

(10) Patent No.: US 6,560,876 B2
(45) Date of Patent: May 13, 2003

(54) DUAL HEADED RAZOR

(76) Inventor: Michael Bryan Strahley Carr, 262 Sain Rd., Statesville, NC (US) 28625

( * ) Notice: Subject to any disclaimer, the term of this patent is extended or adjusted under 35 U.S.C. 154(b) by 0 days.

(21) Appl. No.: 09/892,097

(22) Filed: Jun. 26, 2001

(65) Prior Publication Data

US 2002/0194735 A1 Dec. 26, 2002

(51) Int. Cl.[7] ..... B26B 21/54
(52) U.S. Cl. ..... 30/50; 30/34.1; D28/46
(58) Field of Search ..... 30/32, 34.05, 34.1, 30/47, 50, 526; D28/45, 46, 47, 48

(56) References Cited

U.S. PATENT DOCUMENTS

| | | | | | |
|---|---|---|---|---|---|
| 1,380,272 | A | * | 5/1921 | Tomasulo | 30/197 |
| 4,461,078 | A | | 7/1984 | Carreker | 30/47 |
| 4,989,328 | A | * | 2/1991 | Sokoloff | 30/34.1 |
| D343,922 | S | * | 2/1994 | Ahlgren | D28/46 |
| 5,307,564 | A | | 5/1994 | Schoenberg | 30/50 |
| D423,143 | S | * | 4/2000 | Cowell | D28/46 |
| 6,052,905 | A | * | 4/2000 | Branchinelli et al. | 30/50 |
| 6,125,857 | A | | 10/2000 | Silber | 132/215 |

* cited by examiner

*Primary Examiner*—Hwei-Siu Payer
(74) *Attorney, Agent, or Firm*—Olive & Olive, PA

(57) ABSTRACT

The invention relates to manual shaving razors. Particularly, the present invention relates to a shaving razor with a handle with a shaving razor head at each of opposite ends of the razor handle.

5 Claims, 1 Drawing Sheet

DUAL HEADED RAZOR

BACKGROUND OF THE INVENTION

1. Field of the Invention

The present invention relates generally to shaving razors. More specifically it relates to a shaving razor with a separate razor head on opposing ends of a razor handle and which is entirely disposable or has disposable razor heads.

2. Description of Related Art

Shaving razors and like devices are a common part of daily grooming. The number of devices available commercially is staggering with old straight edge razors; single edge safety razors; single, double and even triple bladed disposable razors; and razors with disposable razor heads all sharing shelf space in today's stores. The wide number of different style, shape and size of razors and razor heads available indicates the need for razors that meet a wide variety of needs. These needs include convenience, cost, close shave, ease of use and specialty shaving uses such as shaving, styling and trimming. The patent literature has disclosed an even wider array of razors to fill those needs.

In U.S. Pat. No. 4,461,078 to Carreker, a dual headed styling razor is disclosed. In that patent, a styling razor head is mounted on one razor handle and a shaving razor head is mounted on a separate razor handle. The handles are pivotally mounted together. The razor head-handle assembly enables the user designed to be able to style and shave with the same device. In U.S. Pat. No. 6,125,857 to Silber, opposing trimming razor heads are positioned on the opposing ends of a u-shaped handle for simultaneously trimming both sideburns at once and includes a device for keeping the whole mechanism level. The size of the device is adjustable to match the individuals' head size. Two opposing independent shaving razor heads on the same end of a razor handle are disclosed in U.S. Pat. No. 5,307,564 to Schoenberg. The shaving razor heads are mounted in opposing positions and are not in contact with the skin simultaneously. The razor is designed to provide both an upwardly extending as well as a downwardly extending blade.

As can be seen, many attempts at improvements have been made in dual head razors for shaving, styling, and trimming but many share the problem of being costly, complicated to make and/or use, and inconvenient to use. It would thus be useful to have a dual head shaving razor that is inexpensive, easy to use and care for, and which saves time when being used primarily for shaving.

SUMMARY OF THE INVENTION

The present invention provides a shaving razor with dual shaving razor heads, one on each opposed end of a common razor handle. By "razor handle" is meant a handle roughly of the length to fit into the user's hand. This razor handle has a body portion that can be optionally curved at each end that holds the shaving razor heads. The razor heads of the present invention are mounted so as to face away from the central axis of the common razor handle. The shaving razor head on each razor of the invention may face in the same direction or in different directions. In one embodiment, the razors face opposite directions. The razor handle can have almost any cross section such as square, rectangle, circular or oval as long as it fits into the user's hand for use. A typical diameter of a razor handle is from about ¼ to ½ inch. The improved razor, of the present invention, is also designed in such a way that it is economical to both make and use. Each shaving razor, of the present invention, is adapted to use disposable razor heads such as those by single, double or triple blade, or the entire razor may itself be made so as to be disposable.

The present invention razor has the advantage that it is economical, as one shaving razor of the invention can be made cheaper than two single-head razors of similar size. It is also useful in that it saves time during the shaving process. If the blade in one shaving razor head becomes dull during shaving, the razor can be turned around or flipped over and shaving can immediately continue with the blade of the other razor head. The shaving razor also can be used back and forth due to the opposing nature of the shaving razor heads. Other advantages of the improved dual headed razor of the present invention will be apparent to those skilled in the art from a review of the description as well as reference to the accompanying drawings.

DETAILED DESCRIPTION OF THE PREFERRED EMBODIMENTS

The shaving razor of the invention specifically comprises a razor handle, a first shaving razor head attached to a first handle end and a second shaving razor head attached to a second handle end. The blades used in each razor head are preferably the conventional single, double or triple headed blades available for use in disposable razors such as those currently manufactured by and under trademarks such as BIC, GILLETTE or WILKINSON. Alternatively, the dual headed razor of the present invention may employ replacement razor heads of the type widely available for non-disposable razors.

The razor handle of the invention is normally straight in the body portion and can have a bend at each end which places each shaving razor head at approximately 8–12 degrees off center from the central axis of the razor handle. The shaving razor heads may be mounted so as to face away from the central axis of the razor handle. Embodiments described herein have both razor shaving heads either in the same direction or opposing directions relative to the handle, but in either case away from the handle. The razor handle itself is of a size and shape to comfortably fit in the hand and of a length just sufficient that both shaving razor heads extend out of the hand when the shaving razor is held for shaving. Typical cross sections of handles would be square, rectangular, oval and circular, however, other shapes may be used as well.

Figure 1:
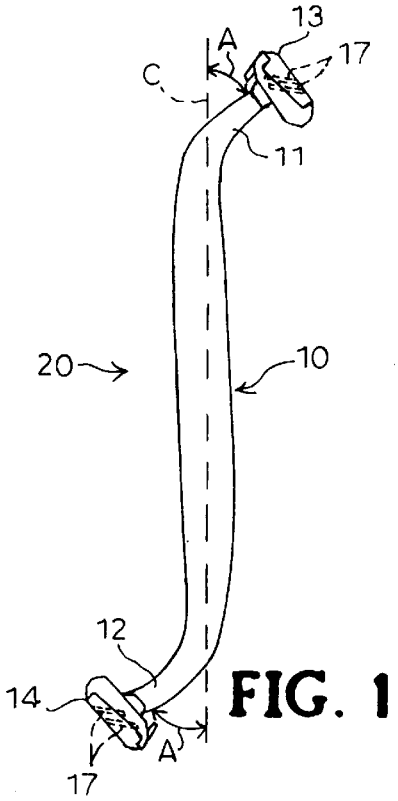
FIG. 1 is a side elevation view of a first embodiment of the invention in which the shaving razor heads are mounted facing in opposite directions and away from the razor handle central axis.

FIG. 1 is a side elevation view of a first embodiment of the invention. The shaving razor 20 has a razor handle 10 with a central axis C. The razor handle 10 has a first handle end 11 and a second handle end 12. Attached to the first handle end 11 and second handle end 12 respectively, are first shaving razor head 13 and second shaving razor head 14. The razor handle 10 has a bend, forming with respect to central axis C an angle A, in each of the first handle end 11 and second handle end 12 of the razor handle 10. The angle A, typically in the range of 8 to 12 degrees, is designed to give the user room to place the user's hand on the razor handle 10 and hold it and leave the shaving razor head at a proper angle to place it against the face for shaving. In this first embodiment, the shaving razor heads 13 and 14 are mounted facing away from central axis C of razor handle 10 in opposing directions. The shaving razor heads 13 and 14 in this first embodiment are of the type which are attached to the handle so that the shaving razor 20 is disposable. The blades in this embodiment are double blade 17.

Figure 2:
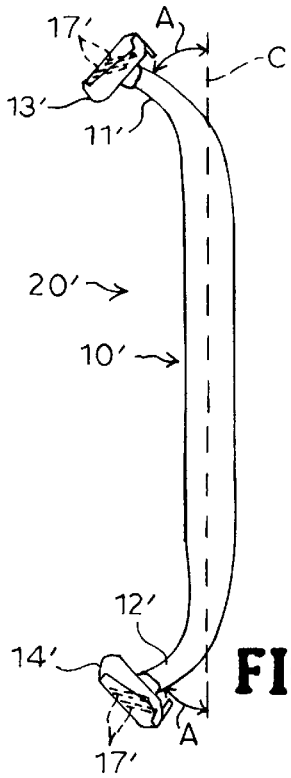
FIG. 2 is a side elevation view of a second embodiment of the invention in which the shaving razor heads are mounted facing the same direction and away from the razor handle central axis.

FIG. 2 is a side elevation view of a second embodiment of the invention. The shaving razor 20' of this second embodiment also has a razor handle 10' and a first handle end 11', and second handle end 12'. Attached to first handle end 11' and second handle end 12' respectively, are first shaving razor head 13' and second shaving razor head 14'. The razor handle 10' is shown formed with a bend of angle A' in each razor handle end 11 and 12 which places the shaving razor head offset from the main part of the razor handle 10'. As compared to the razor handle 10 in FIG. 1, this second embodiment differs from the first embodiment shown in FIG. 1 in that the shaving razor heads 13' and 14' both face the same direction away from central axis C of razor handle 10'. Likewise, the bend of angle A' in each end of the razor handle 10' is in the same direction. As with the first embodiment, each shaving razor head 13' and 14' is positioned to be individually used against the face while holding on to the razor handle 10'.

Figure 3:
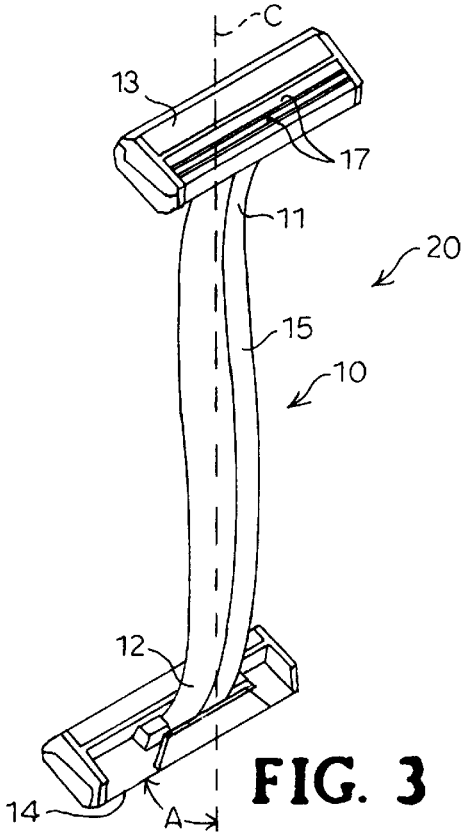
FIG. 3 is a perspective view of the razor shown in FIG. 1.

With reference to FIG. 3, a perspective view of the first embodiment of the shaving razor 20, as in FIG. 1, is shown. As can be seen clearly from FIG. 3, the razor handle 10 has first shaving razor head 13 and second shaving razor head 14 with its dual blades 17 mounted on razor handle ends 11 and 12, respectively and facing in opposite directions. The three-dimensional nature of the razor handle 10 and the relationship of the elements of the shaving razor 20 can be clearly seen in the perspective view of FIG. 3. Angle A, on opposing sides of the razor handle 10, is chosen such that the blades 17 can easily contact the face while the user holds the razor handle 10 of the razor 20 for shaving. Further, if the blade on one end has become dull after using, the razor 20 can be flipped over to use the other end of the shaving razor head.

Further modification of the invention may be made by one of skill in the art without deviating from the scope and spirit of the invention and therefore the description and drawings are not intended to be limiting in any manner.

What is claimed is:

1. A shaving razor comprising:

a) a rigid, non-foldable razor handle having at opposite ends of a substantially straight smooth-surfaced central portion, a first angled handle end portion and an opposing second angled handle end portion;

b) a first shaving razor head attached to an outer end of the said first handle end portion and mounting at least one blade in a plane outwardly offset from and angled with respect to a longitudinal central axis of said central a portion;

c) a second shaving razor head attached to an outer end of the said second handle end portion and mounting at least one blade in a plane outwardly offset from and angled with respect to the central axis of said central portion and of length and width substantially equal to the width and length of the blade mounted in said first shaving razor head; and d) the spacing between said razor heads and the length of said central portion being sufficient to permit both razor heads to be out of a hand of a user when the handle is held for shaving with either razor head.

2. A shaving razor according to claim 1, wherein the first shaving razor head and the second shaving razor head face away from the central axis of the razor handle straight central portion and face the same direction.

3. A shaving razor according to claim 1, wherein the first shaving razor head and the second shaving razor head face away from the central axis of the razor handle straight central portion and in opposite directions.

4. A shaving razor according to claim 1 wherein the first shaving razor head and the second shaving razor head are disposable.

5. A shaving razor according to claim 1 wherein the shaving razor is disposable.

* * * * *